US006034484A

United States Patent [19]

Danov et al.

[11] Patent Number: 6,034,484

[45] Date of Patent: Mar. 7, 2000

[54] PIEZOELECTRONIC BALLAST FOR FLUORESCENT LAMP

[75] Inventors: Henry A. Danov, Moscow, Russian Federation; Byung Whan Kim; Young Min Kim, both of Seoul, Rep. of Korea

[73] Assignee: Korea Tronix Co., Ltd., Seoul, Rep. of Korea

[21] Appl. No.: 08/951,008

[22] Filed: Oct. 15, 1997

[51] Int. Cl.[7] ..... H05B 37/02

[52] U.S. Cl. ..... 315/209 PZ; 315/209 R; 315/244; 315/224; 310/318; 310/316; 310/321

[58] Field of Search ..... 315/209 R, 209 PZ, 315/244, 307, 105, 106, 127, 224; 310/316, 318, 359, 321

[56] References Cited

U.S. PATENT DOCUMENTS

| | | | |
|---|---|---|---|
| 4,107,349 | 8/1978 | Vig | 427/36 |
| 4,256,991 | 3/1981 | Otala | 315/104 |
| 4,630,342 | 12/1986 | Tichy | 29/25.35 |
| 4,742,182 | 5/1988 | Fuchs | 174/52.4 |
| 5,319,284 | 6/1994 | Lee | 315/209 R |
| 5,796,213 | 8/1998 | Kawasaki | 315/209 R |
| 5,856,728 | 1/1999 | Zimnicki et al. | 315/209 PZ |

FOREIGN PATENT DOCUMENTS

| | | |
|---|---|---|
| 0359245 | 3/1990 | European Pat. Off. . |
| 3835533 A1 | 4/1990 | Germany . |
| 2267002 | 5/1992 | United Kingdom . |

*Primary Examiner*—Haissa Philogene
*Attorney, Agent, or Firm*—Staas & Halsey, LLP

[57] ABSTRACT

The application of a piezoceramic resonator (PR), connected in parallel to a discharge lamp and in series to cathode filaments of a lamp, provides reliable means of preheating of cathode filaments facilitating a soft start of a fluorescent lamp. The piezoceramic resonator is a polarized piezoceramic element formed in a form of rectangular plate, disk, cylinder, etc. The linear size and shape of the PR determine the type of oscillation, electromechanical resonant frequency and frequency characteristics. The PRs with radial, contour or longitudinal oscillations are best suited for application to a piezoelectronic ballast. Piezoceramic resonators and filters as frequency-selective elements in measuring and radio communication instruments are widely used in weak alternating electrical fields, where the intensity of field does not exceed an order of volts per mm. The present invention offers the use of a piezoceramic resonator in power electronics as in an electronic ballast where the electrical field intensity reaches an order of hundred volts per mm of thickness of a piezoceramic element. Expansion of frequency band width of resonant characteristic of the PR are achieved by using several piezoceramic resonators with different frequency characteristics in parallel and further by constraining oscillation of piezoceramic resonators mechanically.

9 Claims, 7 Drawing Sheets

PIEZOELECTRONIC BALLAST FOR FLUORESCENT LAMP

FIELD OF THE INVENTION

The present invention relates to a piezoelectronic ballast for a fluorescent lamp in the area of illumination engineering, more particularly, to an electronically starting and controlling device of a fluorescent lamp.

The piezoelectronic ballast of this invention refers to an electronic device composed of semi-conductor discrete devices and integrated circuits as well as piezoceramic functional elements.

BACKGROUND OF THE INVENTION

It is known that the light efficacy of a fluorescent lamp and the stability of the light flow improve when the fluorescent lamp is operated at a higher frequency in comparison with a line frequency of 50 Hz to 60 Hz.

Conventional electromagnetic ballasts having an electromagnetic transformer and a starting device do not meet modern requirements of a high light efficacy, a low harmonic distortion and an extended life time of a fluorescent lamp, because the ballast operates at a low frequency and a voltage spike are not controlled when starting. Recently, an electronic ballast is introduced to meet these requirements.

The basic unit of an electronic ballast operating at a high frequency of 10 kHz to 80 kHz consists of a rectifier, a high-frequency converter and a resonant inductor-capacitor (L-C) circuit, where a discharge fluorescent lamp is included into the resonant L-C circuit.

A good electronic ballast should take care of the following characteristics to secure a long service life of a fluorescent lamp as well as the ballast: (1) cathode filaments of the fluorescent lamp should be normally preheated with an exception of an instant start fluorescent lamp; (2) the voltage spike should be kept low for a soft start; (3) the discharge current should be stabilized after turn-on of a fluorescent lamp; (4) the fluctuation of an input voltage should be considered for stability of the charge and light flow of a fluorescent lamp; (5) the power factor and end of life behavior of a fluorescent lamp should be considered; (6) the harmonic distortion of a fluorescent lamp should be low; and (7) the electromagnetic interference should be avoided.

EP Patent No. 0359245 discloses an electronic ballast but it does not meet all the above requirements. The majority of modern fluorescent lamps are supplied with cathodes filaments located at the ends of a glass tube to improve the starting behavior and thus to extend the life time of the lamps. Preheating of the cathode filaments creates space charges which reduce an ionization voltage significantly and thus facilitate a soft start of a lamp—a start of arranged movement of ions and an avalanche increase of electrical current in a lamp. In order to extend the life time of a fluorescent lamp, the preheating current should be regulated properly and the starting voltage minimized to protect emitters from a strong starting current spike and voltage spike.

In an electronic ballast of DE Patent No. 3835533 A1, a thermally sensitive resistor, a thermistor is added in parallel to a starting capacitor to regulate preheating current. The thermally sensitive resistor provides a means of preheating of cathodes before starting a fluorescent lamp. With the main switch on, a large preheating current begins to flow through the cathode filaments due to a low resistance value of a thermistor. When the resistance of the thermistor switches to a high resistance state with the preheating current flowing through it, the main resonant circuit starts working and a high voltage develops across the lamp enough for starting the lamp. Because the resistance of a thermistor depends on the surrounding temperature, the preheating current cannot be accurately regulated at a wide range of operating temperature. In addition, when a lamp is turned off and turned on again in a short time, the preheating effect will be diminished due to a slower recovery of resistance of a thermally sensitive resistor.

GB Patent No. 2267002 discloes an electronic ballast based on a resonant L-C circuit in which an auxiliary capacitor is connected in parallel to a fluorescent lamp to preheat filaments in addition to a starting capacitor. The auxiliary capacitor is disconnected in a predetermined time by a timer relay switch and then the main resonant process provides a high voltage for a start-up of a lamp. In this prior art, the preheating current for cathode filaments is supplied by the charging and discharging process of the capacitor, which shows a big in-rush preheating current that is deleterious to the life time of a lamp.

U.S. Pat. No. 5,319,284 discloes an electronic ballast consisted of a rectifier, a pulse generator connected with a half-bridge transistor switch converter, a first resonant L-C circuit with a damping circuit connected to a fluorescent lamp, and a second resonant circuit with the inductor and capacitor connected in parallel to the lamp. In this prior art, the second resonant circuit having a higher resonating frequency provides a means of preheating of cathode filaments while the first resonant circuit having a lower resonating frequency provides a starting voltage. In this prior art, it is very difficult to set the preheating and starting conditions precisely due to dual resonating circuits with inductors and capacitors.

OBJECTS OF THE INVENTION

An object of the present invention is to provide a ballast circuit using for a discharge fluorescent lamp, which meets modern requirements such as a stable preheating condition for a soft start of the lamp, a mild starting condition, etc.

Another object of the present invention is to provide a ballast circuit using for a discharge fluorescent lamp to extend the life time of the lamp by facilitating a soft start.

A further object of the invention is to provide a ballast circuit employing piezoceramic resonators therein for controlling the preheating current and the start-up condition.

The foregoing and other objects of the present invention will be achieved in the following description.

SUMMARY OF THE INVENTION

The application of a piezoceramic resonator PR, which is connected in parallel to a discharge fluorescent lamp FL and in series to cathode filaments of the fluorescent lamp, provides a reliable means of preheating of cathode filaments so as to facilitate a soft start of a fluorescent lamp.

The piezoceramic resonator PR is a polarized piezoceramic element formed in a form of a rectangular plate, a rectangular bar, a square plate, a square bar, a disk or a cylinder. The linear size and shape of the PR determine the type of oscillation, electromechanical resonant frequency, and frequency characteristics. The PRs having radial, contour or longitudinal oscillations are best suited for application to a piezoelectronic ballast.

Piezoceramic resonators and filters as frequency-selective elements in measuring and radio communication instruments are widely used in a weak alternating electrical field, where the intensity of field does not exceed an order of volts per mm.

The present invention offers the use of a piezoceramic resonator in power electronics as in an electronic ballast where the electrical field intensity reaches an order of hundred volts per mm of thickness of a piezoceramic element. Expansion of frequency band width of resonant characteristic of the PR is achieved by using several piezoceramic resonators having different frequency characteristics in parallel and further by constraining oscillation of piezoceramic resonators mechanically.

BRIEF DESCRIPTION OF THE DRAWINGS

The present invention will be more fully understood by reference to the following detailed description of the preferred embodiments of the present invention when read in conjunction with the accompanying drawings.

DETAILED DESCRIPTION OF THE INVENTION

Figure 1:
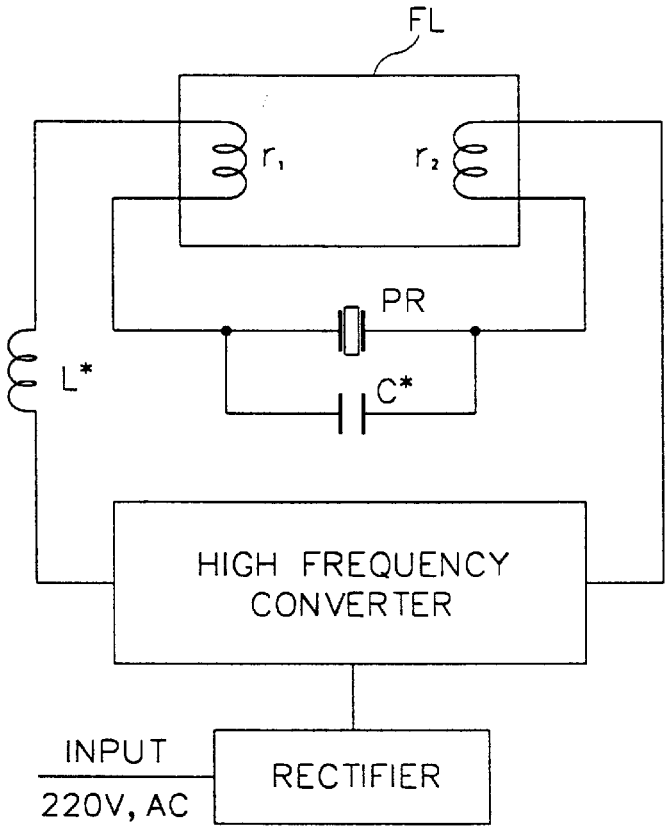
FIG. 1 is a block diagram of a piezoelectronic ballast for a fluorescent lamp FL which incorporates the principle of the present invention.

A schematic arrangement of a piezoelectronic ballast is shown in FIG. 1. It consists of a gas-discharge fluorescent lamp FL, a high-frequency converter, and a source of constant voltage including a rectifier. Cathode filaments $r_1$ and $r_2$ of the fluorescent lamp FL are connected with a high frequency converter and a piezoceramic resonator PR.

The piezoceramic resonator PR has its own static capacity $C_{01}$ and is connected to the fluorescent lamp FL in parallel. A power of 220 V or 110 V is supplied to the input of the piezoelectronic ballast. A rectifier output is connected to the input of a high frequency converter which is in turn connected with a fluorescent lamp FL through an inductor L*. The inductance of L* and the static capacitance $C_{01}$ of the PR define the main L-C resonance condition of a piezoelectronic ballast.

When the power supply of the ballast switches on, a constant voltage arrives at the high frequency converter through the rectifier, as shown in FIG. 1. The amplitude increases from 0 voltage to a high voltage depending on the input line voltage, for example, to 320 V in case of 220 V input voltage. When the voltage at the converter reaches a threshold value, the converter begins to generate high-frequency pulses, which is fed to the load, to a fluorescent lamp. In the initial moment, as the starting frequency of converter is set to a frequency higher than the resonance frequency of the PRs which in turn is well above the main resonant frequency defined by L* and $C_0=C_{01}+C^*$, the lamp voltage does not reach the level required for an ionization of a fluorescent lamp and thus a start-up of the lamp does not happen. At this frequency, because the impedance across the fluorescent lamp remains at several hundreds of kΩ but the impedance of the PRs remains in the range of several tens of Ω due to the resonance nature of PRs, current flows mainly through two cathode filaments $r_1$ and $r_2$ series-connected to PRs, which provides a means of preheating current to the cathode filaments while the frequency sweeps down to the main resonance frequency.

Figure 2:
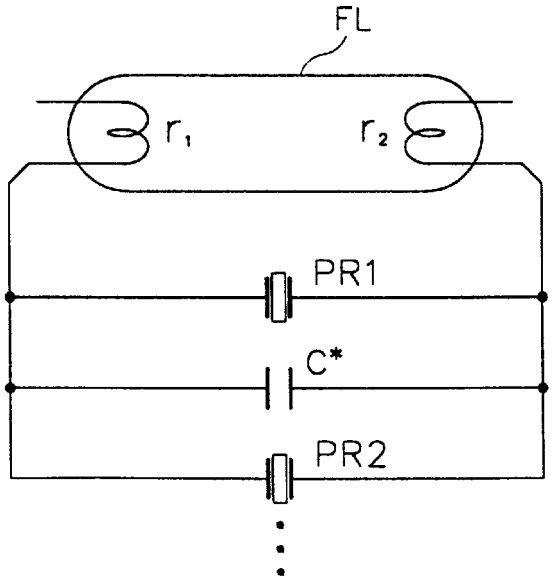
FIG. 2 is a schematic diagram of a piezoelectric ballast according to the present invention with a fluorescent lamp in-series connected with two or more piezoceramic resonators PR1, PR2, etc. and an additional capacitor C*.

Effective preheating of the cathode filaments requires a certain level of preheating current and preheating time. Preheating current is determined mainly by impedance of PRs as well as both resistance of the cathode filaments and impedance of the inductor L*. Preheating effect can be adjusted by changing frequency characteristics of PRs and the resonance circuit. The frequency band width measured at a level of 70% of the peak conductivity depends on piezoelectric coefficients of $k_{ij}$ and mechanical quality factor $Q_m$ which in turn depend on vibration mode, piezoceramic material, mounting method and resistance of electrical loads. The frequency band width of conductivity can be expanded by connecting two or more PRs in parallel and further by connecting an additional capacitor C* in parallel as shown in FIG. 2. The piezoceramic resonator PR1, PR2, etc. can be made of different piezoceramic compositions having different electrophysical and piezoelectric properties such as $E_{33}$, $Q_m$ and $k_{ij}$, or of different geometrical sizes having the same composition in order to expand overall frequency band width.

Figure 3:
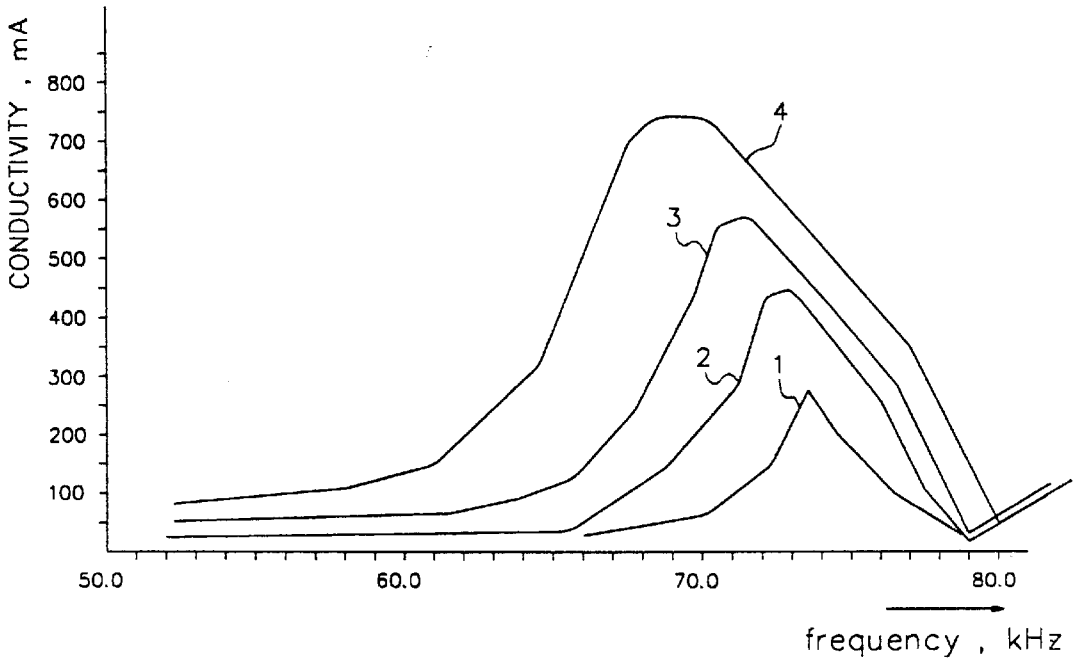
FIG. 3 is a graph showing a dependence of conductivity on an input electric field strength for a piezoceramic resonator made of soft piezoceramic materials.

The PR shows a strong nonlinearity of peizoelectric parameters under a strong electrical field. FIG. 3 shows the effect of electric field on the frequency characteristics of conductivity of a square plate PR around the resonance frequency of 50 kHz to 80 kHz. In FIG. 3, curve 1 is for 10 V/mm, curve 2 is for 20 V/mm, curve 3 is for 30 V/mm, and curve 4 is for 50 V/mm. It can be noted that the frequency band width is expanded as much as about 4 times when the electric field strength increases from 10 to 50 V/mm, and that the resonant frequency shifts towards the low frequency side by 4 to 5 kHz. These effects caused by nonlinearity of electrophysical properties of PRs under a strong electric field are utilized for preheating of cathode filaments in a piezoelectronic ballast of the present invention. In a high frequency converter having a self-oscillation circuit, the oscillation frequency depends on the input voltage. In a piezoelectronic ballast of the present invention, the frequency sweeps from a high preheating frequency to a low working frequency to provide preheating effect, for example, from 80–90 kHz at the beginning of turn-on, and then to 40–50 kHz at working.

Figure 4:
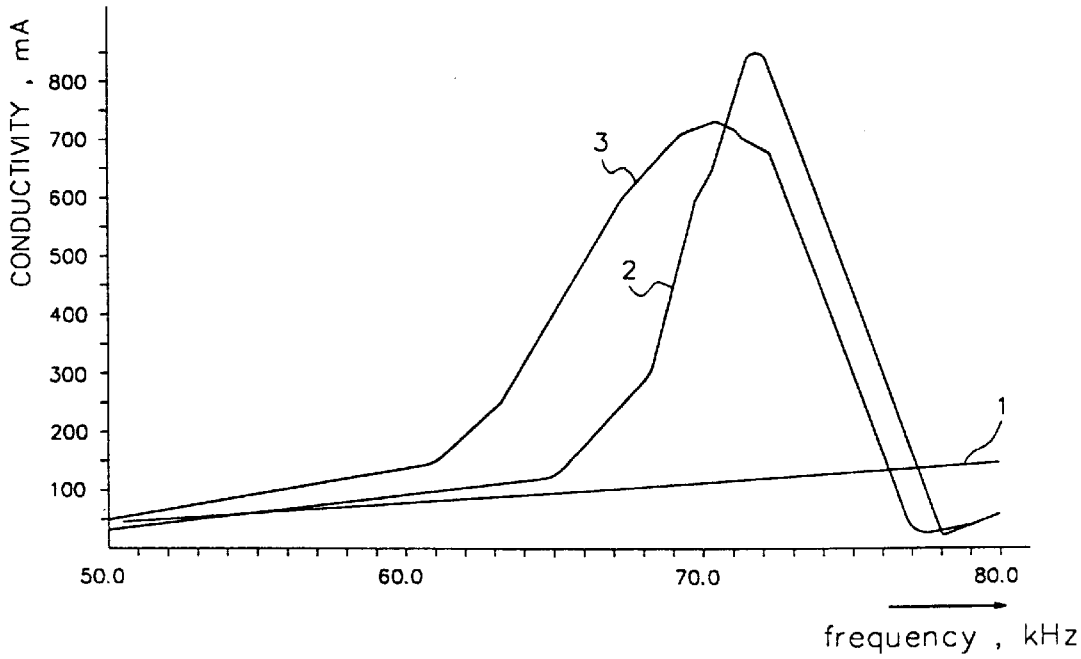
FIG. 4 is a graph showing a frequency characteristics of the conductivity of a piezoceramic resonator having an additional capacitor in parallel.

Frequency characteristics of conductivity of a resonant circuit is shown in FIG. 4 for a circuit having a capacitor only (C*=4 nF: curve 1), a circuit having a piezoceramic resonator only ($C_{01}$=4 nF: curve 2) and a circuit having a capacitor and a piezoceramic resonator connected in parallel ($C_0=C_{01}+C^*$: curve 3) in a strong electrical field of 30 V/mm. In the third case, the additional capacitor C* together with $C_{01}$ and inductor L* make the main resonant circuit of an electronic ballast. As the output frequency of the converter approaches to the main resonance frequency defined by $C_0$ and L*, the voltage across the fluorescent lamp increases to the level necessary for a start of lamp by main resonance effect. Thus, after preliminary heating of cathodes by resonance effect of piezoceramic resonator itself, a soft start of a fluorescent lamp is executed in a piezoelectric ballast.

The essence of the present invention is that at least one frequency-selective piezoceramic resonator is installed in parallel to a fluorescent lamp in the main resonant circuit to ensure an optimal preheating of cathode filaments and starting of a fluorescent lamp. Preheating effect is maximized by utilizing resonance behavior of a PR in the resonant circuit of a ballast and separating the preheating frequency from the lamp working frequency.

The invention may be better understood by reference to the following embodiments which are intended for purposes of illustration and are not to be construed as in any way limiting the scope of the present invention, which is defined in the claims appended hereto.

Figure 5:
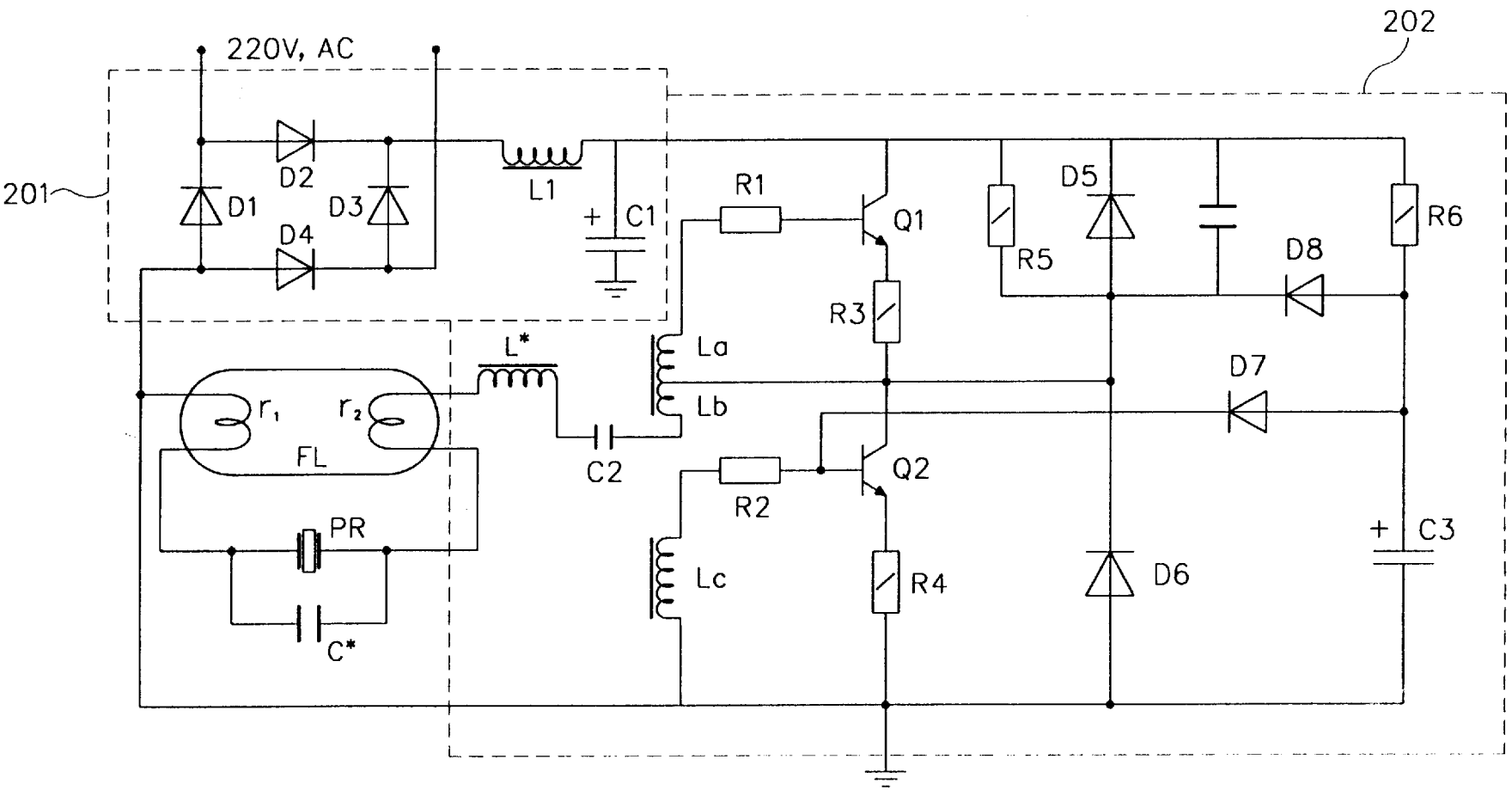
FIG. 5 is a circuit diagram of a piezoelectronic ballast for a fluorescent lamp FL based on a self-oscillation circuit with a piezoceramic resonator.

FIG. 5 shows a piezoceramic resonator PR, a capacitor C* connected in parallel to a fluorescent lamp FL, a high frequency converter 202 based on a self-oscillation scheme and a rectifier circuit 201.

Figure 6:
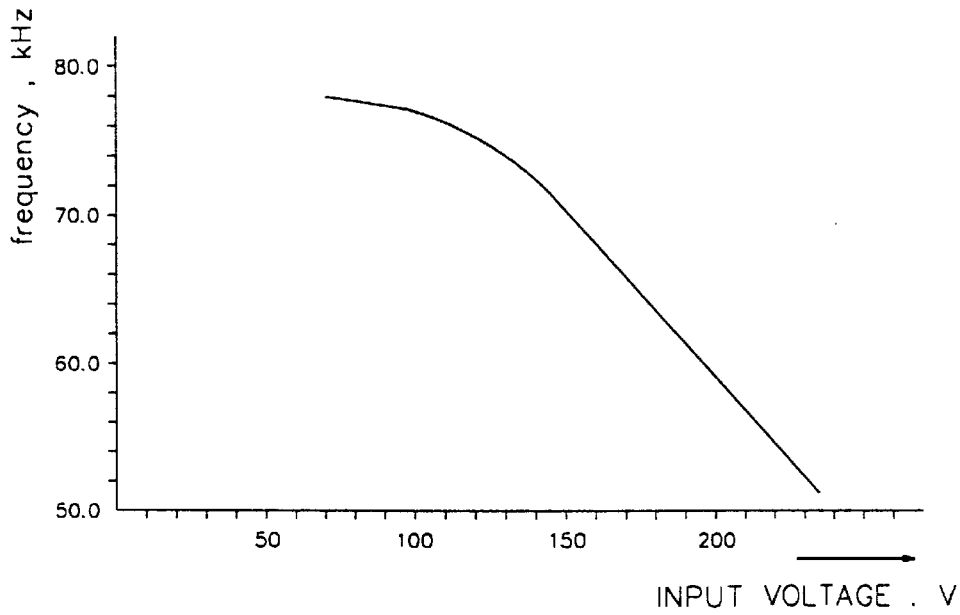
FIG. 6 is a graph showing a self-oscillation frequency as a function of an input voltage of a self-oscillation converter.

The high-frequency converter 202 is built on a half-bridge circuit having bipolar transistors Q1 and Q2 with an inductive emitter-base connection through inductors La, Lb and Lc. The output frequency of the self-oscillator is determined by inductances of inductors La, Lb and Lc as well as resistances of resistors R1 and R2 installed in the base circuits of output transistors. The starting circuit of the self-oscillator consists of time-controlling elements R6 and C3, and diodes D8 and D7. Diodes D5 and D6 are included to protect transistors Q1 and Q2 from a reverse voltage breakdown. The output winding of a transformer Lb is connected with an inductor L* through a dividing capacitor C2. An inductor L* is connected to a piezoceramic resonator PR in series through the right cathode filament $r_2$. The other electrode of the piezoceramic resonator PR is connected to the common bus of a converter in series through the left-hand cathode filament $r_1$. An additional capacitor C* is connected in parallel to a PR to expand the frequency band width. A DC voltage source 201 fed to the high frequency converter consists of rectifying diodes D1–D4 and a smoothing circuit having a choke L1 and a capacitor C1. Static capacitance of the piezoceramic resonator and capacitance of the capacitor, $C_{01}$ and C*, respectively, and inductance L* define a main resonance condition of a ballast. The output frequency of the self-oscillating circuit is dependent on the input voltage as shown in FIG. 6. The output frequency decreases with an increase of the input voltage.

The converter in FIG. 5 works as follows.

With a switch-on of power supply of line voltage of 220V, the capacitor C1 begins to charge through the choke L1 from 0 to 300–320 V, a peak voltage of the line input voltage, and at the same time the capacitor C3 charges by current through a resistor R6. When the voltage of the capacitor C3 increases with charging to the threshold level for operation of the starting circuit, the diode D7 is fast triggered and a short triggering pulse of voltage enters the base of the transistor Q2 of the self-oscillator and finally a high frequency output voltage develops in the converter circuit. Frequency controlling elements of the converter—La, Lb, Lc, R1 and R2—are chosen in such a manner that the converter starts to work at a higher frequency such as 80–85 kHz than the resonant frequency of a piezoceramic resonator and the main resonance frequency of ballast. At this initial stage with a higher frequency, the voltage across the fluorescent lamp FL is much less than the breakdown voltage and no current flow through the lamp due to no resonance effect in the main resonant circuit of the ballast.

As the input voltage of the converter increases with time, the output frequency approaches the resonance frequency of the PR and its impedance starts to decrease and becomes minimum at the resonance frequency of the PR, where the parallel circuit almost shunts. Thus, significant electric current begins to flow through the PR and the cathode filaments $r_1$ and $r_2$ and heats up the filaments. As the output frequency sweeps down the frequency, the impedance of the PR increases again. When the frequency approaches the main resonance frequency of the ballast defined by L* and $C_0=C_{01}+C^*$, the voltage across the fluorescent lamp starts to increase by resonance effect. When the lamp voltage reaches a threshold value of avalanche ionization, the lamp becomes activated and the discharge current begins to flow through it.

Figure 7:
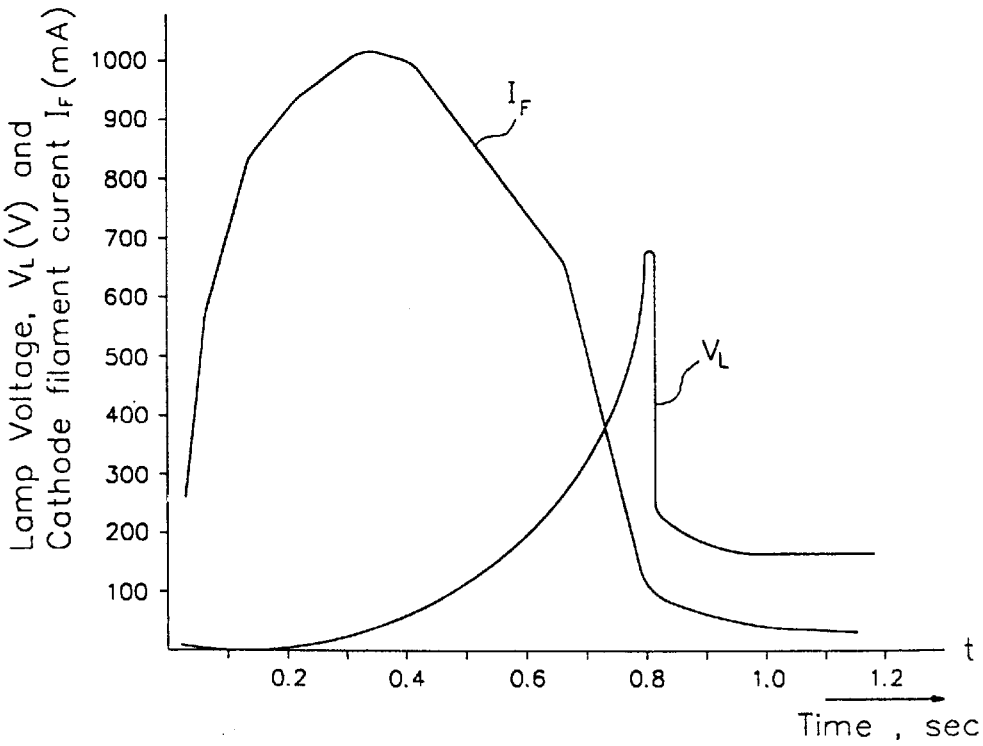
FIG. 7 is a graph showing time-dependence of the lamp voltage and cathode filament current in a piezoelectronic ballast.

As far as the frequency characteristics of conductivity of the PR has a wide band width and its resonance frequency is higher than the main resonance frequency, preheating of the cathode filaments can be achieved before starting the lamp in the piezoelectric ballast shown in FIG. 5, i.e. a soft start of the lamp is facilitated. Time characteristics of current flowing through the cathode filaments and of lamp voltage of the piezoelectronic ballast are shown in FIG. 7. Approximately at 0.8 sec after turn-on, the lamp voltage reaches a breakdown value of about 640 V and the lamp starts. Cathode filaments are preheated by the currents shown in the FIG. 7 arising from the resonance effect of the PR before starting the lamp. Preheating time is set mainly by the frequency characteristics of a piezoceramic resonator and the main resonant circuit.

Figure 8:
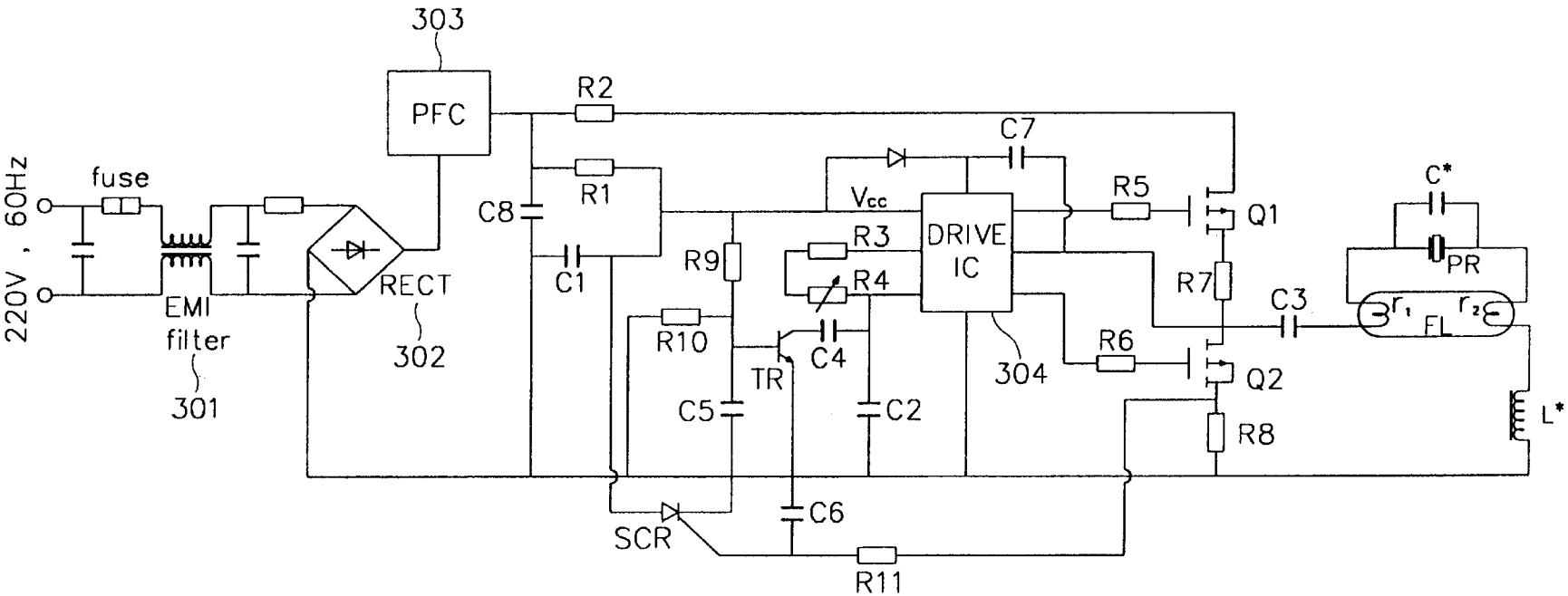
FIG. 8 is a circuit diagram of a piezoelectronic ballast for a fluorescent lamp based on a high-frequency converter having a high frequency drive IC.

Based on the present invention, a piezoelectronic ballast for a fluorescent lamp of a big power can be built more reliably with a high frequency drive IC 304 as shown in FIG. 8, which comprises a DC source having an EMI filter 301 and a rectifier 302, a power factor correction circuit 303, a converter, a piezoceramic resonator PR connected in parallel to a fluorescent lamp FL, a capacitor C* connected in parallel to the fluorescent lamp FL, an inductor L* to regulate the lamp current, an overcurrent protection circuit, and a control circuit of frequency sweep time.

The converter is built on the basis of a high-frequency drive DC 304 and a half-bridge circuit of a power amplifier having transistor switches Q1 and Q2. The static capacitance $C_{01}$ of the PR, capacitance of an additional capacitor C*, and inductance of inductor L* define the main resonance condition of a piezoelectronic ballast. $V_{cc}$ is a source voltage for operation of the drive IC, the resistors R3 and R4 and capacitor C2 set the starting frequency, and the resistor R9 and capacitor C5 set the time of frequency sweep. The capacitor C6 is for by-passing. Positive and negative outputs of the drive IC are connected to the inputs of switch transistors Q1 and Q2 via restrictive resistors R5 and R6.

A piezoceramic resonator PR is included in parallel to a fluorescent lamp FL and in series with cathode filaments $r_1$ and $r_2$. The output of the right cathode filament is connected through an inductor L* to common bus of a piezoelectronic ballast.

The piezoelectronic ballast in FIG. 8 works in the following way. At feeding of alternating line voltage, the high-frequency drive IC begins to work by the DC voltage fed through the power factor correction circuit. The initial frequency of the drive IC is set by resistors R3 and R4 and a capacitor C2.

Figure 9:
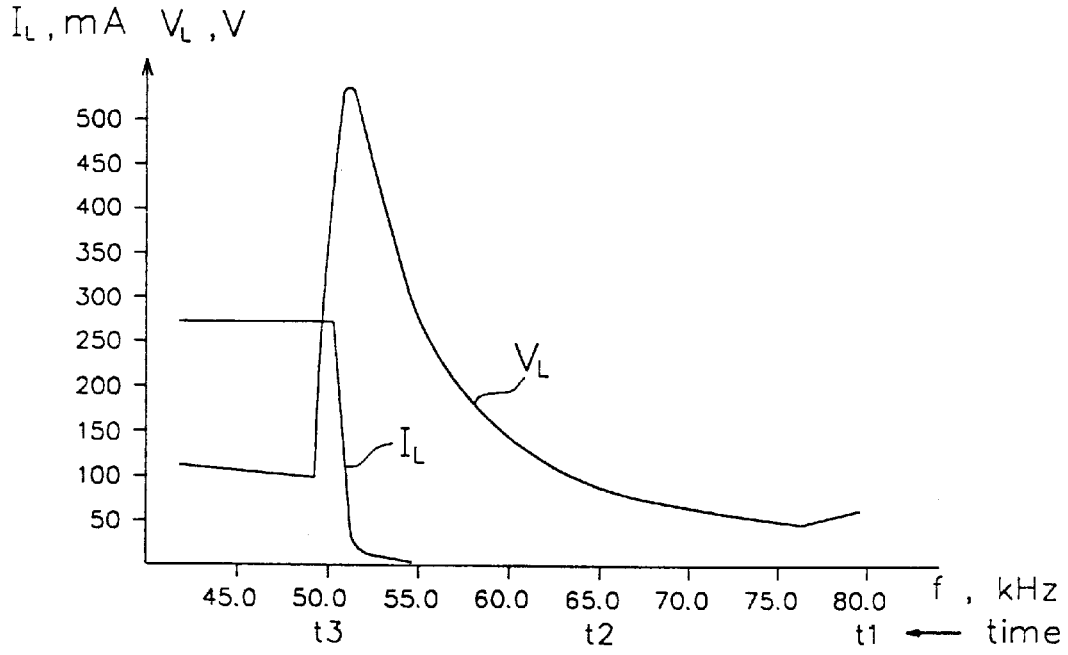
FIG. 9 is a graph showing the lamp voltage and current as a function of time/frequency of a piezoelectronic ballast for a fluorescent lamp based on a high-frequency converter having a high frequency drive IC.

Changes of the lamp voltage and lamp current are shown in FIG. 9 as a function of time/frequency. In accordance with an increase of voltage on the storage capacitor C1, the input source voltage $V_{cc}$ of driver increases. At some moment t=t1, the drive IC begins to produce rectangular pulses, which come to the power transistor switches and then to the input of fluorescent lamp through a dividing capacitor C3. The output frequency of the drive IC decreases with an increase of source voltage $V_{cc}$, approaching to the resonant frequency ($f_r$) of the piezoceramic resonator PR.

Impedance of the piezoceramic resonator becomes minimum at $f=f_r$ in the range of several tens of Q and maximum current flows from switching transistor to the cathodes filaments $r_1$ and $r_2$. The maximum current is limited by inductive impedance of an inductor. Preheating of cathode filaments proceeds during the time when the frequency of the drive IC remains within the frequency band of resonant characteristic of the PR. In this time period, the frequency of the drive IC is much larger than the main resonance frequency, the lamp voltage remains low, and the lamp is not activated due to no resonance effect of the main resonant circuit.

When the frequency approaches the main resonance frequency, the PR behaves as a pure capacitor and the lamp voltage starts to increase by the main resonance effect of the ballast. Nominal inductance of the inductor is chosen according to optimum lamp current based on the main working frequency of the ballast. At the main resonance frequency, the lamp voltage becomes maximum and reaches a breakdown voltage of the fluorescent lamp. Up to this moment, the cathode filaments are already preheated and thus abundant space charges are formed around it, facilitating a soft start of lamp-avalanche ionization with development of powerful flow of ions (discharge current) and subsequent lighting of the lamp.

Preheating effect can be adjusted to specific requirements of a fluorescent lamp by changing the time of frequency sweep. The circuit of setting frequency sweep time and of selecting frequency from the preheating frequency to the starting and working frequency comprises an additional capacitor C4 connected in parallel to the frequency setting capacitor C2 of the drive IC, a transistor TR of which collector is connected to the additional capacitor C4 and of which base is connected to the circuit of the frequency time controlling circuit consisted of a resistor R9 and a capacitor C5 connected between the source line of the drive IC and the common bus of the ballast. When the bias voltage of the transistor TR reaches a cut-in voltage by charging of the capacitor C5, the transistor turns on and the output frequency changes to the lamp starting and working frequency set by the capacitance of capacitors C4 and C2. Sweep time is set by resistance of the resistor R9 and capacitance of the capacitor C5.

An overcurrent arising at the end of the life of a fluorescent lamp can cause a failure of transistors Q1 and Q2, leading to total failure of the ballast. In order to protect the piezoelectronic ballast, an overcurrent protection circuit is included in this embodiment of the current invention. The resistor R8 detects an overcurrent and then turns on the SCR, turning off source voltage $V_{cc}$ to stop operation of the drive IC.

Figure 10:
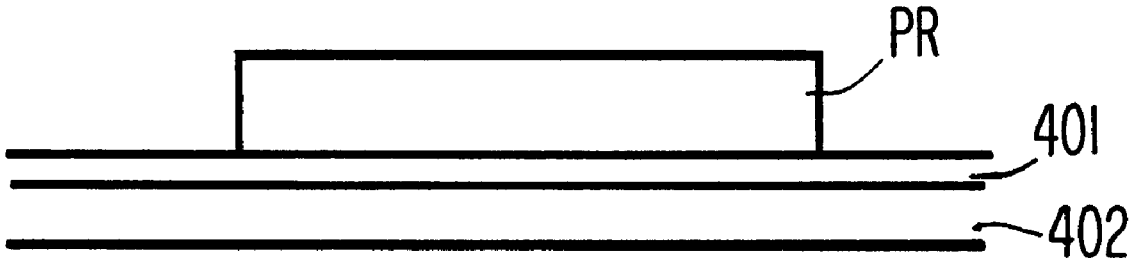
FIG. 10 is a diagram showing a piezoceramic resonator mounted on a PCB.

In both embodiments, piezoceramic materials of a PZT system ($PbTiO_3$—$PbZrO_3$ system) are used in the manufacturing of the PRs. The PRs made of a soft or average ferroelectric piezoceramic material have adequate piezoelectric and mechanical properties which determine its frequency-impedance characteristics. Piezoceramic resonators are made by a standard ceramic processing, which comprises dry compaction, sintering, Ag electroding and polarization. As shown in FIG. 10 the Piezoceramic resonator PR is mechanically mounted on the PCB 402 with an adhesive 401 such as silicone, to expand the frequency band width of resonance characteristics.

It is apparent from the above that many modifications and changes are possible without departing from the spirit and scope of the present invention.

What is claimed is:

1. A piezoelectronic ballast used for a fluorescent lamp comprising:

a source of constant voltage including a rectifier;

a high-frequency converter;

gas-discharge fluorescent lamp; and a resonant circuit having a piezoceramic resonator, wherein cathode filaments of the fluorescent lamp are connected with the high frequency converter and the piezoceramic resonator, wherein said piezoceramic resonator is connected in parallel to the fluorescent lamp and in series with cathode filaments of the fluorescent lamp and an inductor, forming an inductor-capacitor resonant circuit.

2. The piezoelectronic ballast as claimed in claim 1, further comprising a capacitor connected in parallel to said piezoceramic resonator.

3. The piezoelectronic ballast as claimed in claim 2, further comprising at least two piezoceramic resonators having different frequency characteristics connected in parallel to said piezoceramic resonator.

4. The piezoelectronic ballast as claimed in claim 2, wherein said piezoceramic resonator is mechanically mounted on a PCB with an adhesive to expand the frequency characteristics.

5. A piezoelectronic ballast, used for a fluorescent lamp comprising:

a source of constant voltage including a rectifier;

a high-frequency converter;

gas-discharge fluorescent lamp; and a resonant circuit having a piezoceramic resonator, wherein cathode filaments of the fluorescent lamp are connected with the high frequency converter and the piezoceramic resonator, wherein said piezoceramic resonator serves to preheat cathode filaments by their own resonance characteristics at a frequency higher than a main resonance frequency, and the piezoelectronic ballast further comprises a means for starting main resonance of the fluorescent lamp at a main working frequency.

6. The piezoelectronic ballast as claimed in claim 5, further comprising at least two piezoceramic resonators having different frequency characteristics connected in parallel to said piezoceramic resonator.

7. A piezelectronic ballast used for a fluorescent lamp comprising:

a DC source having an EMI filter and a rectifier;

a power factor correction circuit;

a converter with switch transistors;

a gas-discharge fluorescent lamp;

a piezoceramic resonator connected in parallel to the fluorescent lamp;

an inductor to regulate a lamp current;

an over current protection circuit consisting of a resistor detecting overcurrent by voltage and a SCR which turns on by the voltage developed in the resistor to shunt of a source voltage of a drive IC to protect the ballast; and a control circuit for frequency sweep time consisting of a capacitor and a transistor both connected in parallel to the frequency setting capacitor of the drive IC.

8. The piezoelectronic ballast as claimed in claim 7, further comprising a capacitor connected in parallel to said piezoceramic resonator.

9. The piezoelectronic ballast as claimed in claim 8, further comprising at least two piezoceramic resonators having different frequency characteristics connected in parallel to said piezoceramic resonator.

* * * * *